US010531713B2

(12) United States Patent
Nishida et al.

(10) Patent No.: US 10,531,713 B2
(45) Date of Patent: Jan. 14, 2020

(54) FASTENER STRINGER AND SLIDE FASTENER

(71) Applicant: YKK Corporation, Tokyo (JP)

(72) Inventors: Eiji Nishida, Toyama (JP); Takayuki Minatozaki, Toyama (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 16/062,623

(22) PCT Filed: Jan. 7, 2016

(86) PCT No.: PCT/JP2016/050376
§ 371 (c)(1),
(2) Date: Jun. 14, 2018

(87) PCT Pub. No.: WO2017/119104
PCT Pub. Date: Jul. 13, 2017

(65) Prior Publication Data
US 2018/0368537 A1 Dec. 27, 2018

(51) Int. Cl.
*A44B 19/54* (2006.01)
*A44B 19/34* (2006.01)
*A44B 19/12* (2006.01)

(52) U.S. Cl.
CPC ..... *A44B 19/54* (2013.01); *A44B 19/12* (2013.01); *A44B 19/346* (2013.01)

(58) Field of Classification Search
CPC ..... A44B 19/10; A44B 19/12; A44B 19/346; A44B 19/54; D03D 1/00
See application file for complete search history.

(56) References Cited

U.S. PATENT DOCUMENTS 3,961,652 A * 6/1976 Hasuda ..... A44B 19/34 139/384 B
3,991,795 A * 11/1976 Bainer ..... A44B 19/346 24/392
4,134,185 A * 1/1979 Heimberger ..... A44B 19/343 24/393

(Continued)

FOREIGN PATENT DOCUMENTS

EP 0 080 167 A2 6/1983
EP 1 050 228 A2 11/2000

(Continued)

OTHER PUBLICATIONS

International Preliminary Report on Patentability, PCT Patent Application No. PCT/JP2016/050376, dated Jul. 19, 2018.

(Continued)

*Primary Examiner* — Robert Sandy
*Assistant Examiner* — David M Upchurch
(74) *Attorney, Agent, or Firm* — Kilpatrick Townsend & Stockton LLP

(57) ABSTRACT

A plurality of warp threads includes total N adjacent tightening threads each repeats crossing over N second legs at a side of the first tape-surface and crossing over the weft thread at a side of the second tape-surface so as to tighten the coil-shaped element to the weft thread. Said N indicates a natural number equal to or greater than 2. Each tightening thread includes an exposed portion that crosses over the weft thread and is exposed at a side of the second tape-surface. As the N adjacent tightening threads extend, the respective exposed portions of the tightening threads appear at a side of the second tape-surface one-by-one alternately or one-by-one sequentially.

20 Claims, 7 Drawing Sheets

(56) References Cited

U.S. PATENT DOCUMENTS 4,210,180 A * 7/1980 Tsubata ..... A44B 19/346 139/384 B
4,220,182 A * 9/1980 Glindmeyer ..... A44B 19/346 139/384 B
4,254,803 A * 3/1981 Tsubata ..... A44B 19/346 139/384 B
4,334,556 A * 6/1982 Frohlich ..... A44B 19/346 139/384 B
4,467,840 A * 8/1984 Tsubata ..... A44B 19/406 139/384 B
4,498,503 A 2/1985 Ofusa
4,623,004 A * 11/1986 Matsushima ..... A44B 19/406 139/384 B
4,675,951 A * 6/1987 Hasegawa ..... A44B 19/14 24/401
4,915,140 A * 4/1990 Ofusa ..... A44B 19/40 139/384 B
5,140,725 A * 8/1992 Matsushima ..... A44B 19/34 139/384 B
5,472,019 A * 12/1995 Shimono ..... A44B 19/406 139/384 B
5,983,465 A * 11/1999 Wakai ..... A44B 19/34 24/392
6,418,975 B1 7/2002 Shimino
2008/0110211 A1* 5/2008 Shimono ..... A44B 19/54 66/193
2008/0209694 A1* 9/2008 Horikawa ..... A44B 19/346 24/381
2010/0107374 A1* 5/2010 Nakayama ..... A44B 19/12 24/399
2014/0237778 A1 8/2014 Yagyu

FOREIGN PATENT DOCUMENTS

JP 62-041609 Y2 10/1987
JP 01-091803 A 4/1989
JP 2000-287719 A 10/2000
WO 2013/051127 A1 4/2013

OTHER PUBLICATIONS

International Search Report, PCT Patent Application No. PCT/JP2016/050376, dated Mar. 29, 2016.

* cited by examiner

FASTENER STRINGER AND SLIDE FASTENER

TECHNICAL FIELD

The present disclosure is related to fastener stringers and slide fasteners.

BACKGROUND ART

Patent literature 1 discloses a type of an exemplary fastener stringer in which warp threads include pressing warp threads for pressing a coil-shaped element against weft threads. FIG. 1 of the same literature illustrates total 4 adjacent tightening threads 19-22. The tightening threads 19-22 extend to cross over a top surface of the top leg 31 and a bottom surface of the bottom leg 32 alternately. FIG. 4 of the same literature illustrates total 4 adjacent tightening threads. With respect to the total 4 tightening threads, 2 tightening threads at a side of engaging head 33 extend to cross over a top surface of the top leg 31 and a bottom surface of the bottom leg 32 alternately, similar to that described for FIG. 1. As illustrated, the remaining 2 tightening threads extend differently to the two tightening threads at the side of the engaging head 33.

CITATION LIST

Patent Literature

[Patent literature 1] Japanese Examined Utility-Model Publication No. 62-41609

SUMMARY

Technical Problem

Further improvement of endurance against lateral-pulling-force has been desired for a fastener stringer in which a coil-shaped element is tightened to a weft thread by tightening threads included in warp threads. If engaging heads of coil-shaped element are arranged at small pitch interval, a weft thread arranged at a space between adjacent legs of coil-shaped element in an elongated direction of a fastener stringer may be relatively steeply or greatly entrained by tightening threads of warp threads to a side of tape surface of a fastener tape on which the coil-shaped element is provided. As a result, non-negligible recesses may possibly be formed on a tape surface of the fastener tape on which the coil-shaped element is not provided. In a case where the weft thread between the legs of coil-shaped element is caught by a plurality of tightening threads, there is a possibility that larger recesses may be formed. The present inventor has newly recognized a problem to avoid or suppress formation of recesses at a tape-surface of a fastener tape opposite to a tape-surface on which a coil-shaped element is provided while achieving small-pitch arrangement of engaging heads.

Solution to Problem

A fastener stringer according to an aspect of the present disclosure may include: a fastener tape that includes one or more weft threads and a plurality of warp threads, the fastener tape having a first tape-surface and a second tape-surface; and a coil-shaped element that is provided onto the fastener tape so as to appear at a side of the first tape-surface of the fastener tape, the coil-shaped element including a series of unit structures, each unit structure including: a first leg that extends along the weft thread; a second leg arranged farther away from the weft thread than the first leg; an engaging head that couples the first leg and the second leg at a position outwardly of fastener tape; and a return portion that couples the first leg and a second leg of an adjacent unit structure at a position inwardly of fastener tape, wherein

- the plurality of warp threads includes total N adjacent tightening threads each repeats crossing over N second legs at a side of the first tape-surface and crossing over the weft thread at a side of the second tape-surface so as to tighten the coil-shaped element to the weft thread, said N indicating a natural number equal to or greater than 2, wherein
- each tightening thread includes an exposed portion that crosses over the weft thread between the first legs arranged adjacent in a length direction of the fastener tape and that is exposed at a side of the second tape-surface, and wherein
- as the total N adjacent tightening threads extend, the respective exposed portions of the tightening threads appear at a side of the second tape-surface one-by-one alternately or one-by-one sequentially.

In some embodiments, the total N adjacent tightening threads is referred to as a first group of tightening threads, the plurality of warp threads includes a second group of tightening threads including total M adjacent tightening threads each repeats crossing over M second legs at a side of the first tape-surface and crossing over the weft thread at a side of the second tape-surface so as to tighten the coil-shaped element to the weft thread, said M indicating a natural number equal to or greater than 2, and the fastener tape includes a tape texture arranged between the first group of tightening threads and the second group of tightening threads.

In some embodiments, the plurality of warp threads includes a third group of tightening threads including total R adjacent tightening threads each repeats crossing over R second legs at a side of the first tape-surface and crossing over the weft thread at a side of the second tape-surface so as to tighten the coil-shaped element to the weft thread, said R indicating a natural number equal to or greater than 2, and the fastener tape includes a tape texture arranged between the second group of tightening threads and the third group of tightening threads.

In some cases, the tape texture includes a plain weave structure.

In some cases, said N and said M and said R indicate the same number.

A slide fastener according to another embodiment of the present disclosure includes: a pair of fastener stringers according to any one described above; and at least one slider for opening and closing the pair of fastener stringers, wherein

- a pull tab attached to a pull-attachment column provided at a top wing of the slider is arranged at a side of the second tape-surface of the fastener tape.

Advantageous Effects of Invention

According to an aspect of the present disclosure, it may be possible to avoid or suppress formation of recesses at a tape-surface of a fastener tape opposite to a tape-surface on which a coil-shaped element is provided while achieving small-pitch arrangement of engaging heads.

DESCRIPTION OF EMBODIMENTS

Hereinafter, non-limiting exemplary embodiments of the present invention will be described with references to FIGS. 1 to 7. One or more disclosed exemplary embodiments and respective features included in the exemplary embodiment are not mutually exclusive. A skilled person would properly combine the respective exemplary embodiments and/or respective features without requiring excess descriptions. A skilled person would also understand synergic effect by such combinations. Overlapping descriptions among exemplary embodiments will be basically omitted. Referenced drawings are mainly for the purpose of illustrating an invention and may possibly be simplified for the sake of convenience of illustration.

Figure 1:
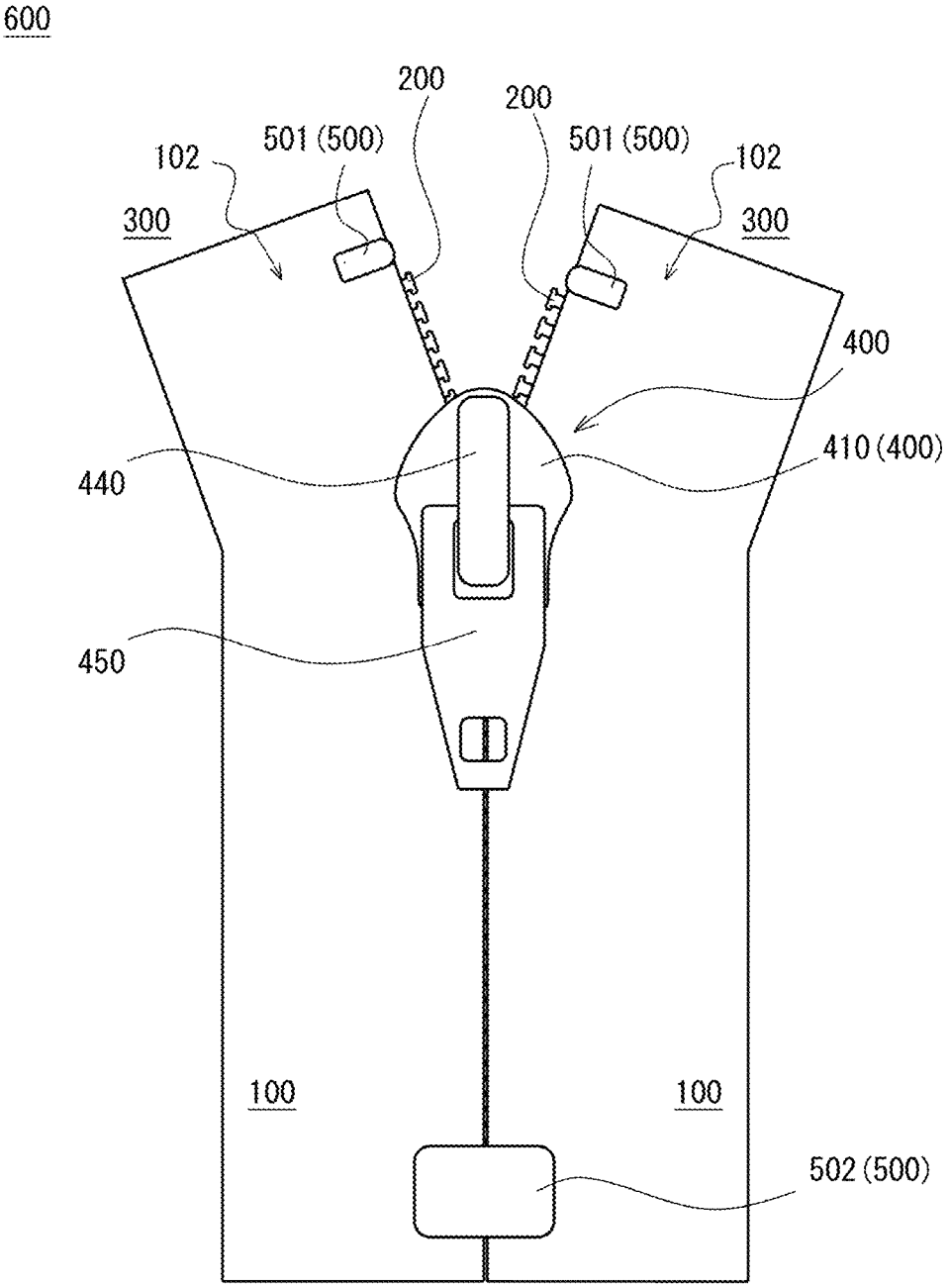
FIG. 1 is a schematic elevational view of a slide fastener according to an exemplary embodiment of the present disclosure.

A slide fastener 600 shown in FIG. 1 includes a pair of left-right fastener stringers 300, and a slider 400 that moves frontward or rearward so as to open or close the pair of left-right fastener stringers 300. The frontward movement of the slider 400 closes the pair of left-right fastener stringers 300. The rearward movement of the slider 400 opens the pair of left-right fastener stringers 300. The slider 400 includes a top wing 410, a bottom wing (not shown), a coupling pillar that couples the top wing 410 and the bottom wing, and a pull-attachment column 440 that is provided on the top wing 410, and a pull tab 450 attached to the pull-attachment column 440. It should be noted that, in some embodiments, sliders having a structure other than that of illustrated exemplary slider 400 would be employed.

Front-rear direction will be understood based on a movement of the above-described slider 400. Left-right direction will be understood from lateral arrangement of the pair of fastener stringers 300 to be opened and closed by the above-described slider 400. The left-right direction is orthogonal to the front-rear direction. Up-down direction is orthogonal to the front-rear direction and the left-right direction.

Each fastener stringer 300 includes a fastener tape 100 and a coil-shaped element 200. The fastener tape 100 includes one or more weft threads 10 and a plurality of warp threads 20. The fastener tape 100 is a woven fabric in which the weft thread 10 and the warp threads 20 are woven. The fastener tape 100 has a first tape-surface 101 and a second tape-surface 102 that is opposite to the first tape-surface 101.

The coil-shaped element 200 is provided onto the fastener tape 100 such that it appears at a side of first tape-surface 101 of the fastener tape 100. The coil-shaped element 200 includes a plurality of and a series of unit structures 210. The unit structure 210 includes a first leg 211 that extends along the weft thread 10, a second leg 212 that extends along the weft thread 10 and/or the first leg 211 and is arranged farther from the weft thread 10 than the first leg 211, an engaging head 213 that couples the first leg 211 and the second leg 212 at a position outwardly of fastener tape, and a return portion 214 that couples the first leg 211 and a second leg 212 of an adjacent unit structure 210 at a position inwardly of fastener tape. The engaging head 213 has projections projected to both sides in a length direction of the fastener tape 100 so that appropriate engagement between left and right engaging heads 213 is ensured. The length direction of the fastener tape 100 matches the front-rear direction.

Inwardly of fastener tape may indicate a direction directed from a position or point external to the fastener tape 100 to a position or point on the fastener tape 100 in a plane in which the fastener tape 100 exists. More particularly, inwardly of fastener tape may indicate a direction that is directed from a position or point external to the fastener tape 100 to a position or point on the fastener tape 100 while crossing an opposed side edge portion of the fastener tape 100. Outwardly of fastener tape may indicate a direction directed from a position or point on the fastener tape 100 to a position or point external to the fastener tape 100 in a plane in which the fastener tape 100 exists. More particularly, outwardly of fastener tape may indicate a direction that is directed from a position or point on the fastener tape 100 to a position or point external to the fastener tape 100 while crossing an opposed side edge portion of the fastener tape 100.

The fastener tape 100 is a woven fabric in which the weft thread 10 and the warp threads 20 are woven. A loom is utilized to configure a fastener tape 100 from the weft thread 10 and the warp threads 20. The loom forms a coil-shaped element 200 in parallel to the formation of fastener tape 100, and embeds the coil-shaped element 200 in the fastener tape 100. Legs of coil-shaped element that is made of a spirally wound monofilament are tightened to the weft thread 10 by tightening threads 30 included in the warp threads 20.

Figure 2:
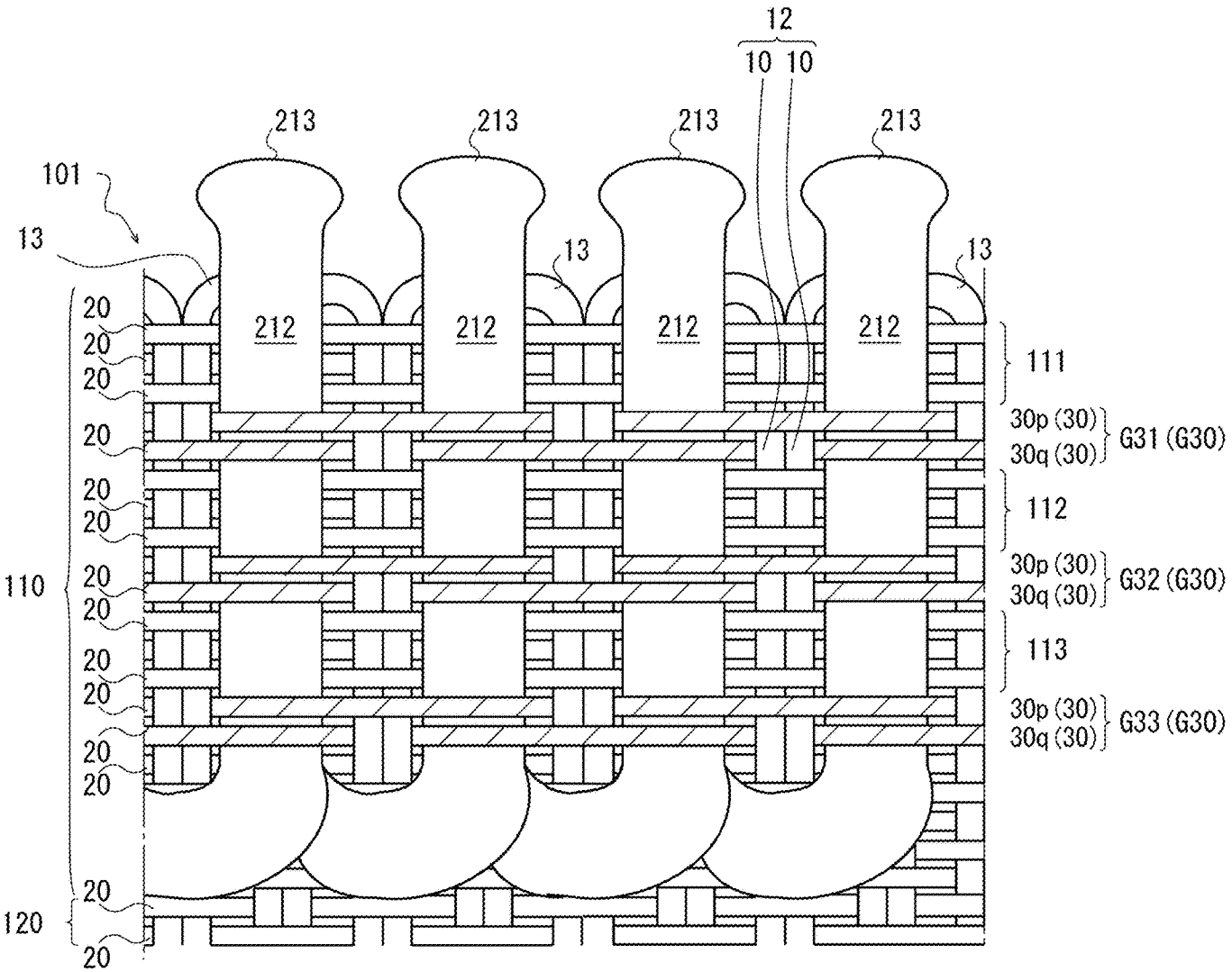
FIG. 2 is a schematic partially expanded view of a fastener stringer according to an exemplary embodiment of the present disclosure, showing that a coil-shaped element is tightened and attached to a weft thread by tightening threads at a side of first tape-surface of a fastener tape.
Figure 3:
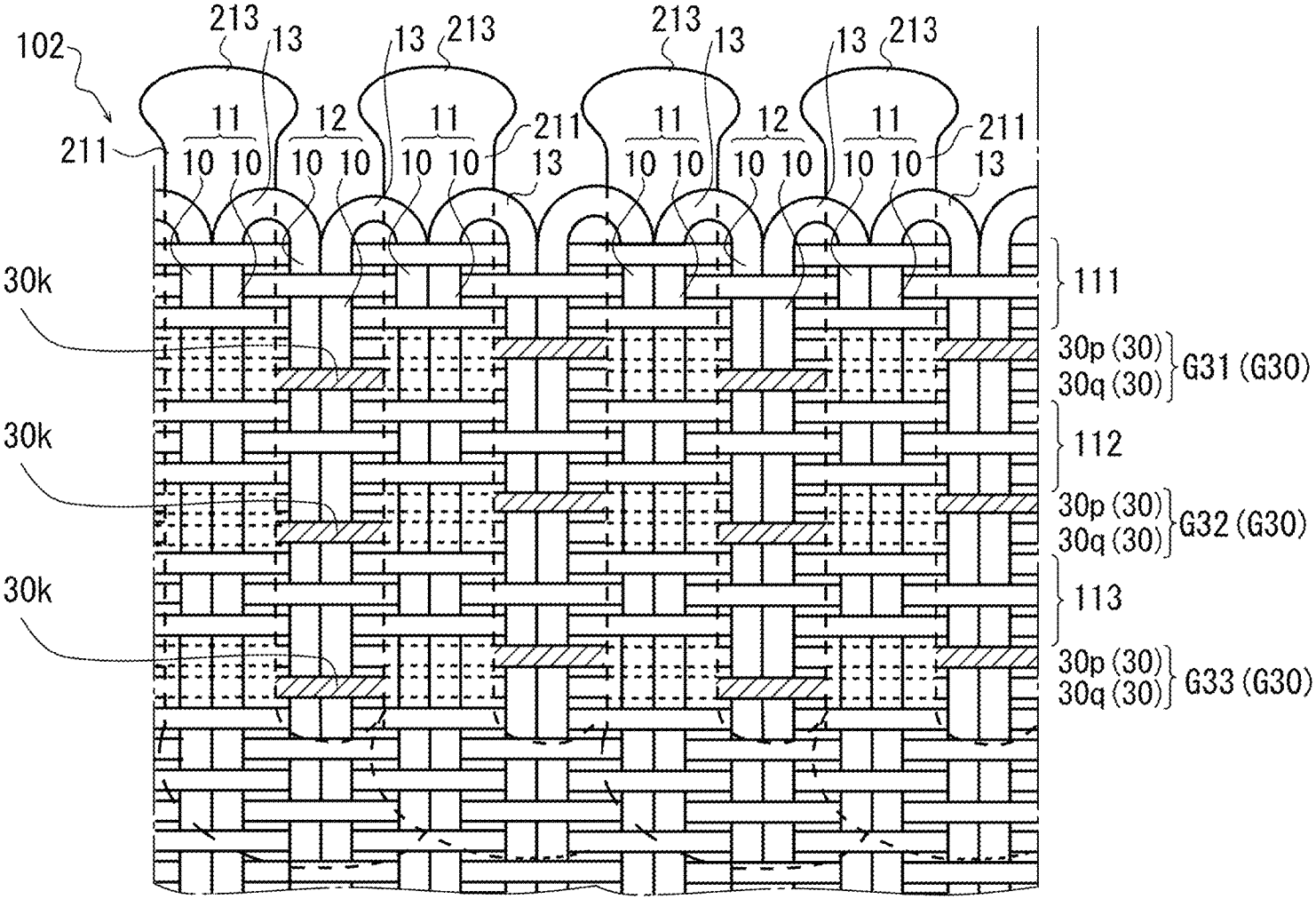
FIG. 3 is a schematic partially expanded view of a fastener stringer according to an exemplary embodiment of the present disclosure, showing that tightening threads cross over a weft thread between adjacent legs of coil-shaped element and are exposed at a side of second tape-surface of a fastener tape.

As shown in FIGS. 2 and 3, the weft thread 10 includes weft thread main portions that extend in a width direction of the fastener tape 100. The width direction of fastener tape 100 is orthogonal to the length direction of fastener tape 100. The width direction of fastener tape 100 matches the left-right direction. The warp thread 20 extends in the length direction of fastener tape 100. In particular, as shown in FIG. 3, one or more weft threads 10 included in the fastener tape 100 includes a first pair 11 of weft thread main portions onto which a first leg 211 is at least partially overlaid at a side of first tape-surface 101 of the fastener tape 100. The one or more weft threads 10 included in the fastener tape 100 further includes a second pair 12 of weft thread main portions provided between the first legs 211 that are adjacent in the length direction of fastener tape 100. The first pair 11 of weft thread main portions and the second pair 12 of weft thread main portions are arranged alternately in the length direction of fastener tape 100.

In some cases, the first pair 11 of weft thread main portions is configured as a result of that one weft thread 10 makes a round trip in the width direction of fastener tape 100 so that the weft thread main portions are placed side by side. Similarly, the second pair 12 of weft thread main portions is configured by the round trip of one weft thread 10. One weft thread main portion included in the first pair 11 of weft thread main portions is continuously coupled to one weft thread main portion included in the second pair 12 of weft thread main portions via a curved weft thread return portion 13. The paired weft thread main portions configuring the first pair 11 and the paired weft thread main portions configuring the second pair 12 are different portions included in the same single weft thread 10. That is, in this case, the weft thread 10 included in the fastener tape 100 is configured by the first pairs 11 of weft thread main portions and second pairs 12 of weft thread main portions which are formed from the common weft thread 10 and it configures the fastener tape 100 together with the plurality of warp threads 20 by weaving.

The warp threads 20 includes a first warp thread that crosses over the second pair 12 of weft thread main portions at a side of first tape-surface 101 of the fastener tape 100 and crosses over the first pair 11 of weft thread main portions at a side of second tape-surface 102 of the fastener tape 100. The first warp thread floats and emerges from the first tape-surface 101 side to the second tape-surface 102 side by passing through a space between the first pair 11 of weft thread main portions and the second pair 12 of weft thread main portions, and then sinks from the second tape-surface 102 side to the first tape-surface 101 side by passing through a space between the first pair 11 of weft thread main portions and the second pair 12 of weft thread main portions.

The warp thread 20 includes a second warp thread that crosses over the first pair 11 of weft thread main portions at a side of first tape-surface 101 of the fastener tape 100 and crosses over the second pair 12 of weft thread main portions at a side of second tape-surface 102 of the fastener tape 100. The second warp thread floats and emerges from the first tape-surface 101 side to the second tape-surface 102 side by passing through a space between the first pair 11 of weft thread main portions and the second pair 12 of weft thread main portions, and then sinks from the second tape-surface 102 side to the first tape-surface 101 side by passing through a space between the first pair 11 of weft thread main portions and the second pair 12 of weft thread main portions. Plain weave structure of fastener tape 100 is configured by the warp threads 20 and the weft thread 10. It should be noted that the fastener tape 100 can include a structure of a twill weave structure, a satin weave structure or other structures, alternatively or additionally to the plain weave structure.

Figure 4:
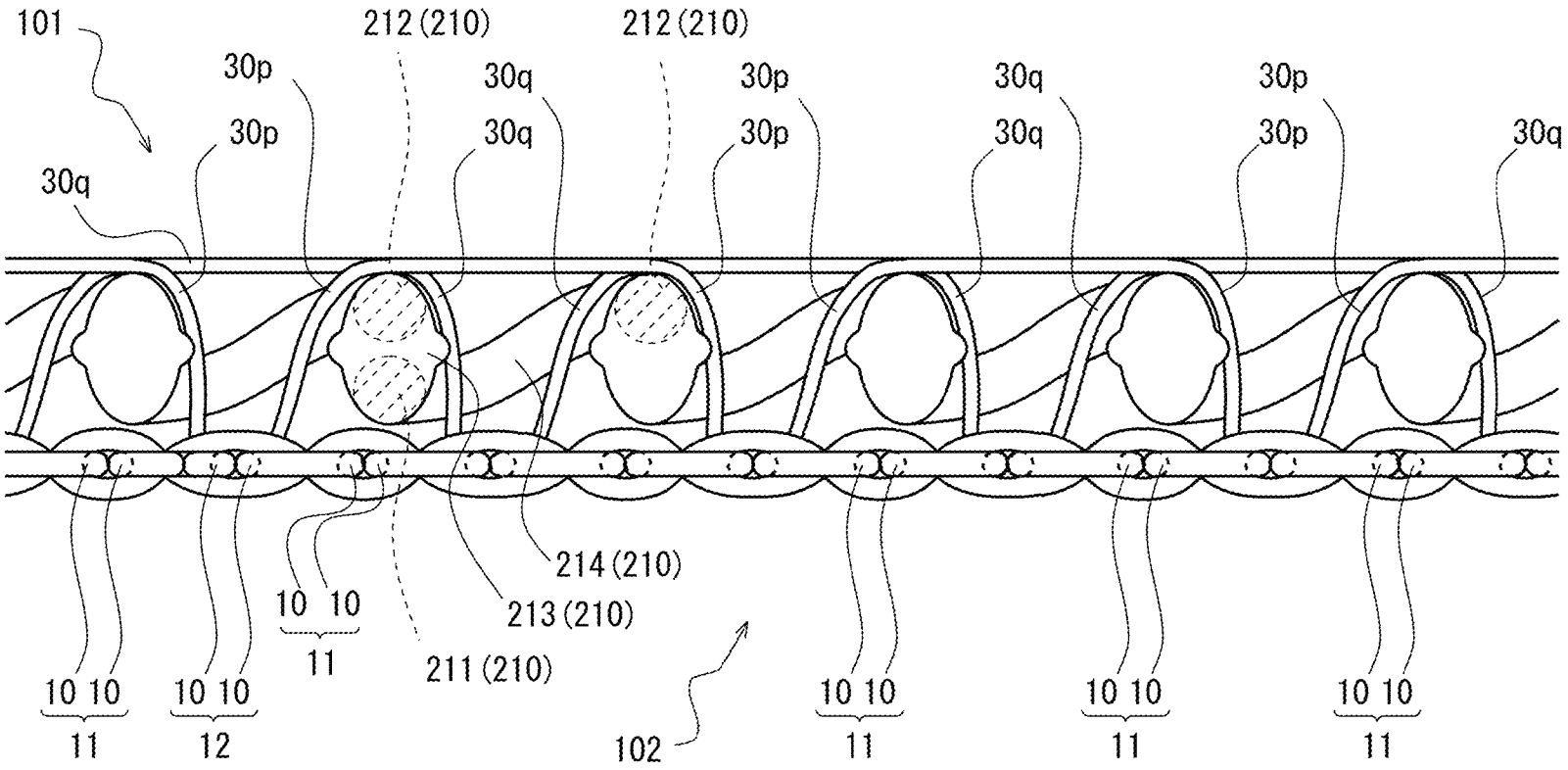
FIG. 4 is a schematic view showing that two adjacent tightening threads included in a fastener tape of a fastener stringer according to an exemplary embodiment of the present disclosure are exposed one-by-one alternately at a side of a second tape-surface.

The warp thread 20 includes total N or more adjacent tightening threads 30 that tighten the coil-shaped element 200 to the weft thread 10. Said N indicates a natural number equal to or greater than 2. In a case shown in FIGS. 2 and 3, N=2. Each of the total N adjacent tightening threads 30 extends so as to tighten the coil-shaped element 200 to the weft thread 10. Each of the total N adjacent tightening threads 30 repeats crossing over N second legs 212 at the first tape-surface 101 side and crossing over, at the second tape-surface 102 side, the weft thread 10, i.e. the second pair 12 of weft thread main portions. Each tightening thread 30 crosses over the weft thread 10, i.e. the second pair 12 of weft thread main portions at a position between the first legs 211 that are adjacent in the length direction of fastener tape 100. In FIG. 2, the tightening threads 30 are schematically hatched for easiness of recognition by eyes. The dotted line of tightening thread 30 shown in FIG. 3 indicates that the tightening threads 30 crosses over the second leg 212 at the first tape-surface 101 side. FIG. 4 specifically shows that total two adjacent tightening threads 30 cross over two second legs 212 at the first tape-surface 101 side, and crosses over the second pair 12 of weft thread main portions at the second tape-surface 102 side.

As shown in FIG. 3, each tightening thread 30 has an exposed portion **30*k* that is exposed at the second tape-surface 102 side while crossing over the weft thread 10, i.e. the second pair 12 of weft thread main portions. As shown in FIG. 4, the exposed portion 30*k* is a part of a tightening threads 30 that emerges to the second tape-surface 102 side by the tightening thread 30 crossing over the weft thread 10, i.e. the second pair 12 of weft thread main portions at a position between the first legs 211 that are adjacent in the length direction of fastener tape 100. Note that, also in FIG. 3, the exposed portions 30*k* are schematically hatched for easiness of recognition by eyes. In the embodiment of the present disclosure, the respective exposed portions 30*k* of the tightening threads 30 appear at a side of the second tape-surface 102 one-by-one alternately as the total N adjacent tightening threads 30 extend. The second pair 12 of weft thread main portions is slightly drawn to the first tape-surface 101 side by the exposed portion 30*k* of the tightening thread 30. Therefore, in a case where the weft thread main portions of the same second pair 12 are drawn all together to the first tape-surface 101 side by the total N adjacent tightening threads 30, then a recess may possibly be formed at the second tape-surface 102 side. It is envisaged that the recess will be larger as the number of tightening threads 30 included in the total N adjacent tightening threads 30** increases. The recess is not preferred from an aspect of design in some cases and other than that, the recess may possibly form a catch on a tape-surface.

In the present exemplary embodiment, the total N adjacent tightening threads 30 are configured such that the above-described pattern of exposed portions **30*k* appears at the second tape-surface 102 side. Therefore, even if the engaging heads 213 are arranged densely in the length direction of fastener tape 100, the weft threads 10, i.e. the weft thread main portions of the second pair 12 all together are not drawn by the N adjacent tightening threads 30 to the first tape-surface 101 side, and thus avoiding or suppressing formation of larger recesses. Moreover, the regular pattern of exposed portion 30*k* presented by the total N adjacent tightening threads 30 appears at the second tape-surface 102 side of fastener tape 10 as a regular design, which not only suppresses the formation of larger recesses or improves the flatness at the second tape-surface 102 side, but also improves a design of the second tape-surface 102 side. As shown in FIG. 1, when the slide fastener 600 is used such that the second tape-surface 102 appears at a facing side, the above feature would be particularly beneficial. Furthermore, according to such arrangement of tightening threads, endurance of coil-shaped elements 200 against lateral-pulling-force is expected to be increased. It should be noted that if N indicates a natural number equal to or greater than 3, then the respective exposed portions 30***k* of the tightening threads 30 appear at a side of the second tape-surface 102 one-by-one sequentially as the N adjacent tightening threads 30 extend.

As shown in FIG. 4 particularly, the tightening threads 30 function as a pressing thread that presses the unit structure 210, i.e. the second leg 212 to the organization of fastener tape 100, and also function as a winding thread that extends across the unit structures 210 that are adjacent in the length direction of fastener tape 100 and restricts displacement of unit structures 210 along the length direction of fastener tape 100. As such, in the illustrated example, the tightening thread concurrently serves as the pressing thread and the winding thread, and thus the tape texture would be simplified compared to an embodiment where pressing threads and winding threads are provided separately to the tightening threads. In other words, in the illustrated example, fixing of the coil-shaped element 200 to the fastener tape 100 is achieved beneficially by the tightening threads only.

Figure 5:
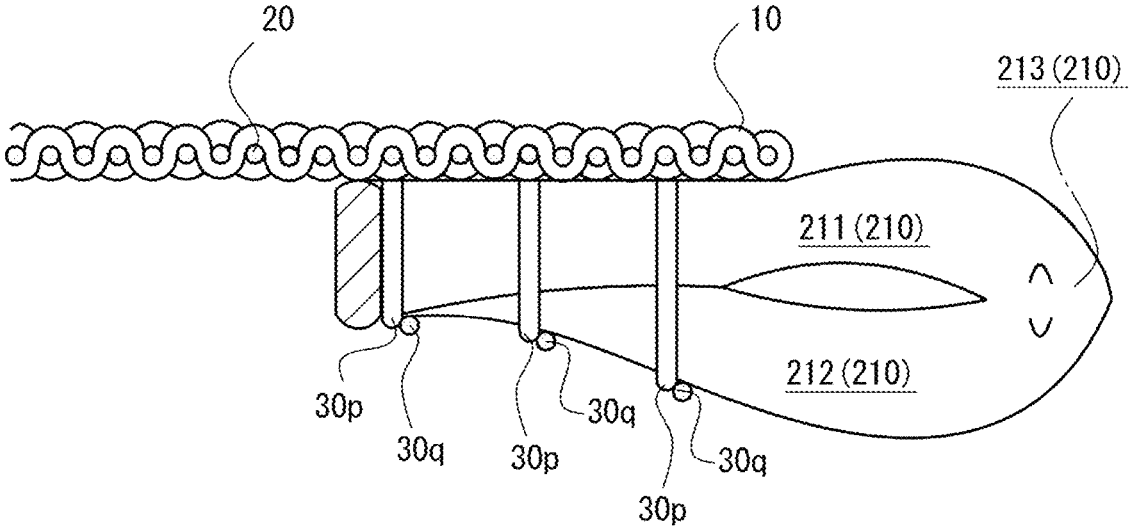
FIG. 5 is a schematic view showing that a leg of coil-shaped element is tightened and attached to a weft thread by tightening threads included in warp threads of a fastener tape in a fastener stringer according to an exemplary embodiment of the present disclosure.

The total 2 adjacent tightening threads 30 are referred collectively as a group G30 of tightening threads. As shown in FIG. 2, FIG. 3 and FIG. 5, the coil-shaped element 200 is tightened to the weft thread 10 by first to third groups G31-G33 of tightening threads. Each of the first to third groups G31-G33 of tightening threads includes total 2 tightening threads 30. In other embodiments, the total number of tightening threads 30 is different in each of the first to third groups G31-G33 of tightening threads. It is assumed that total N tightening threads are included in the first group of tightening threads, total M tightening threads are included in the second group of tightening threads, and total R tightening threads are included in the third group of tightening threads. In some cases, N=M=R is satisfied. In other cases, NWR is satisfied. For example, N=3; the first group G31 of tightening threads includes total 3 tightening threads 30: M=4; the second group G32 of tightening threads includes total 4 tightening threads 30: R=5; the third group G32 of tightening threads includes total 5 tightening threads 30.

The fastener tape 100 has an element-placed-region 110 on which the coil-shaped element 200 is placed, and a tape main portion 120 that is a remaining portion other than the element-placed-region 110. The first to third groups G31-G33 of tightening threads are provided in the element-placed-region 110 and continuously cross over the N second legs 212 of the coil-shaped element 200. A tape texture 112 is provided between the first group G31 of tightening threads and the second group G32 of tightening threads. The tape texture 112 includes a plurality of warp threads 20 (3 warp threads in the illustrated case) which cross over the weft thread 10 and are exposed at the first tape-surface 101 side or the second tape-surface 102 side of the fastener tape 100. In a non-limiting example, the tape texture 112 has a plain weave structure. The tape texture 111 exists at a position outwardly of fastener tape relative to the first group G31 of tightening threads. The tape texture 111 includes a plurality of warp threads 20 (3 warp threads in the illustrated case) which cross over the weft thread 10 and are exposed at the first tape-surface 101 side or the second tape-surface 102 side of the fastener tape 100. In a non-limiting example, the tape texture 111 has a plain weave structure. A tape texture 113 is provided between the second group G32 of tightening threads and the third group G33 of tightening threads. The tape texture 113 includes a plurality of warp threads 20 (3 warp threads in the illustrated case) which cross over the weft thread 10 and are exposed at the first tape-surface 101 side or the second tape-surface 102 side of the fastener tape 100. In a non-limiting example, the tape texture 113 has a plain weave structure. The tape main portion 120 (a plain weave structure as an example) of the fastener tape 100 exists inwardly of fastener tape relative to the third group G33 of tightening threads. The tape texture (a plain weave structure as an example) exists between the plural groups G30 of tightening threads contributes in avoiding or suppressing formation of larger recesses at the second tape-surface 102 side. It should be noted that, in another example, the number of warp threads included in the tape textures 111-113 are different.

In an example of FIG. 3, with respect to the total 2 adjacent tightening threads 30, the exposed portions appear alternately in the length direction of fastener tape 100. This is a 1/1 structure analogous to the 1/1 plain weave structure of the tape main portion 120, allowing the element-placed-region 110 to be much analogous to the tape main portion 120. Furthermore, owing to the tape textures 111-113 existing between the plural groups G30 of tightening threads, the element-placed-region 110 can be more analogous to the tape main portion 120.

The total 2 tightening threads 20 included in the group G30 of tightening threads shown in FIGS. 2 and 3 are referred to as a first tightening thread 30*p* and a second tightening thread 30*q*. FIG. 4 schematically illustrates how the first tightening thread 30*p* and the second tightening thread 30*q* extend along the length direction of fastener tape 100. When heading from the first tape-surface 101 side to the second tape-surface 102 side, the first tightening thread 30*p* passes by a side of the second leg 212 and/or the first leg 211 included in the unit structure 210 of the coil-shaped element 200 at the first tape-surface 101 side, and passes through the space between the first pair 11 of weft thread main portions and the second pair 12 of weft thread main portions. This is followed that the first tightening thread 30*p* crosses over the second pair 12 of the weft thread main portions at the second tape-surface 102 side at a position between the first legs 211 that are adjacent in the length direction of fastener tape 100. When heading from the second tape-surface 102 side to the first tape-surface 101 side, the first tightening thread 30*p* passes through a space between the second pair 12 of weft thread main portions and the first pair 11 of the weft thread main portions, and passes by a side of first leg 211 and/or the second leg 212 included in a unit structure 210 that is adjacent to the above-described unit structure 210. Next, the first tightening thread 30*p* continuously crosses over 2 second legs 212 at the first tape-surface 101 side. At the first tape-surface 101 side of a place where the first tightening thread 30*p* crosses over the second pair 12 of weft thread main portions at the second tape-surface 102 side, there is a second tightening thread 30*q* that crosses over the 2 second legs 212 that are adjacent in the length direction of fastener tape 100.

The second tightening thread 30*q* also makes a round trip or swings between the first tape-surface 101 side and the second tape-surface 102 as extending in a length direction of fastener tape 100 likewise the first tightening thread 30*p*. At the first tape-surface 101 side of a place where the second tightening thread 30*q* crosses over the second pair 12 of weft thread main portions at the second tape-surface 102 side, there is a first tightening thread 30*p* that crosses over the 2 second legs 212 that are adjacent in the length direction of fastener tape 100. As the first tightening thread 30*p* and the second tightening thread 30*q* extend in the length direction of fastener tape 100, the exposed portion 30*k* of the first tightening thread 30*p* appears at the second tape-surface 102 side, and next the exposed portion 30*k* of the second tightening thread 30*q* appears at the second tape-surface 102 side. That is, the exposed portions 30*k* of the tightening threads 30 appear at the second tape-surface 102 side alternately one-by-one as the 2 adjacent tightening threads 30 extend.

There is a second pair 12 of weft thread main portions between the first legs 211 and between the second legs 212 which are adjacent in the length direction of fastener tape 100. The tightening threads 30, having passed over the second legs 212 of the coil-shaped element 200, is required to catch the second pair 12 of weft thread main portion in a relatively short distance in the length direction of fastener tape 100. Compared to cases where two or more second pair 12 of weft thread main portions exist between the first legs 211 and between the second legs 212 which are adjacent in the length direction of fastener tape 100, it is envisioned that, in the preset case, the second pair 12 of weft thread main portions is pulled stronger to the first tape-surface 101 side and the recess can be more noticeable. In the present exemplary embodiment, the total N adjacent tightening threads 30 does not draw the weft thread main portions of second pair 12 all together to the first tape-surface 101 side, avoiding or suppressing the formation of larger recesses regardless of dense arrangement of engaging heads 213.

Figure 6:
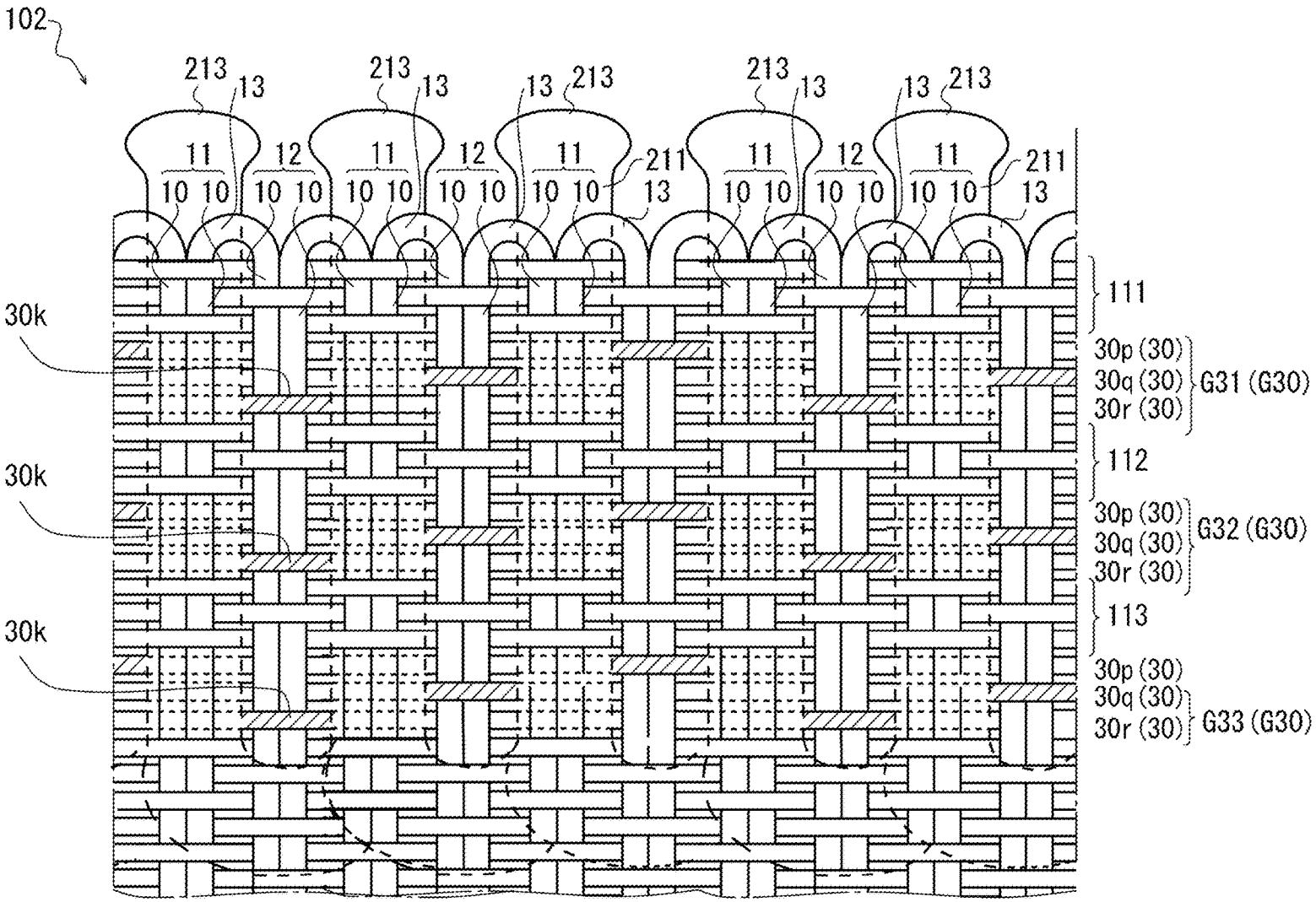
FIG. 6 is a schematic partially expanded view of a fastener stringer according to another exemplary embodiment of the present disclosure, showing that tightening threads cross over a weft thread between adjacent legs of coil-shaped element and are exposed at a side of second tape-surface of a fastener tape.
Figure 7:
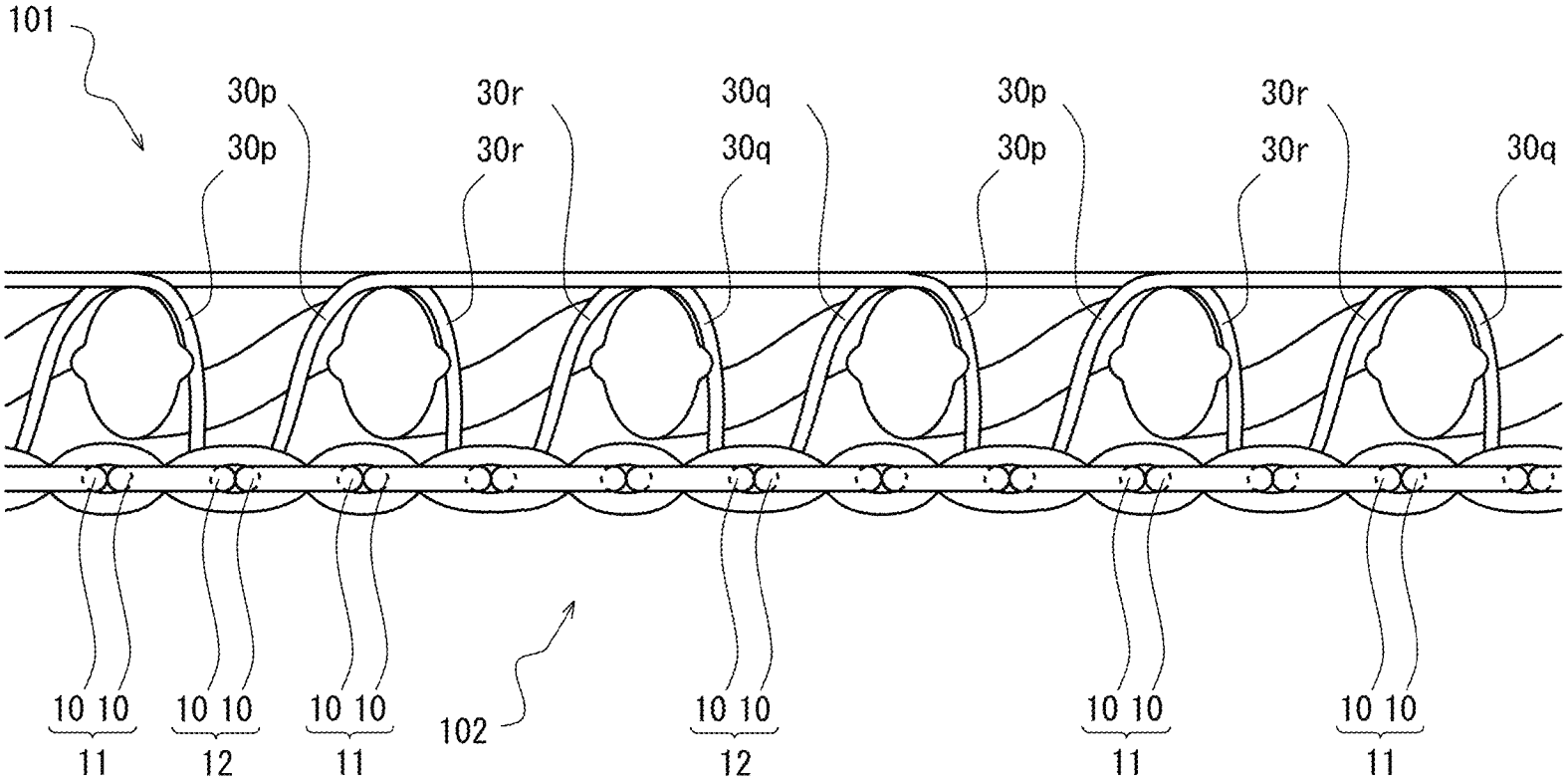
FIG. 7 is a schematic view showing that three adjacent tightening threads included in a fastener tape of a fastener stringer according to another exemplary embodiment of the present disclosure are exposed one-by-one sequentially at a side of a second tape-surface.

FIGS. 6 and 7 illustrates an exemplary embodiment of N=3. As would be understood from FIGS. 6 and 7, the group G30 of tightening threads included in the warp thread 20 includes a third tightening threads 30*r* additionally to the first tightening thread 30*p* and the second tightening thread 30*q*. Each group G30 of tightening threads is configured from total 3 adjacent tightening threads 30. The first to third tightening threads 30*p*-30*r* each repeats crossing over 3 second legs 212 at the first tape-surface 101 side and crossing over the second pair 12 of weft thread main portions at the second tape-surface 102 side. As the first to third tightening threads 30*p*-30*r* extend in the length direction of fastener tape 100, the exposed portion 30*k* of the first tightening thread 30*p* appears at the second tape-surface 102 side, then the exposed portion 30*k* of the third tightening threads 30*r* appears at the second tape-surface 102 side, and then the exposed portion 30*k* of the second tightening thread 30*q* appears at the second tape-surface 102 side. That is, the exposed portions 30*k* of the tightening threads 30 appear at the second tape-surface 102 side sequentially one-by-one as the total N adjacent tightening threads 30 extend. When an exposed portion 30*k* of one tightening thread 30 appears at the second tape-surface 102 side, exposed portion 30*k* of the other tightening thread 30 included in the total N adjacent tightening threads 30 does not appear at the second tape-surface 102 side. One of the total N tightening threads 30 catches the weft thread 10, i.e. the second pair 12 of weft thread main portions. In such a case either, the effects similar to above can be achieved.

A skilled person in the art would understood how a fastener stringer would be manufactured without difficulties, thus undue description is omitted. Reference should be made to the disclosure of Japanese Examined Patent Application Laid-open No. 59-51815, the disclosure of which is incorporated herein by reference.

Given the above teachings, a skilled person in the art would be able to add various modifications to the respective embodiments. Reference codes in Claims are just for reference and should not be referenced for purposes of narrowly construing the scope of claims. An embodiment is envisaged where the tightening threads cross over one weft thread not the pair of weft threads, and this should also be included in the claimed scope.

REFERENCE SIGNS LIST

10 Weft thread
11 First pair of weft thread main portions
12 Second pair of weft thread main portions
20 Warp thread
30 Tightening thread
30 Exposed portion
100 Fastener tape
101 First tape-surface
102 Second tape-surface
200 Coil-shaped element
210 Unit structure
211 First leg
212 Second leg
213 Engaging head
214 Return portion
300 Fastener stringer
600 Slide fastener

The invention claimed is:

1. A fastener stringer comprising:

a fastener tape that includes one or more weft threads and a plurality of warp threads, the fastener tape having a first tape-surface and a second tape-surface; and a coil-shaped element that is provided onto the fastener tape so as to appear at a side of the first tape-surface of the fastener tape, the coil-shaped element including a series of unit structures, each unit structure including:

a first leg that extends along the weft thread;

a second leg arranged farther away from the weft thread than the first leg;

an engaging head that couples the first leg and the second leg at a position outwardly of fastener tape; and a return portion that couples the first leg and a second leg of an adjacent unit structure at a position inwardly of fastener tape, wherein the plurality of warp threads includes total N adjacent tightening threads each repeats crossing over N second legs at a side of the first tape-surface and crossing over the weft thread at a side of the second tape-surface so as to tighten the coil-shaped element to the weft thread, said N indicating a natural number equal to or greater than 2, wherein each tightening thread includes an exposed portion that crosses over the weft thread between the first legs arranged adjacent in a length direction of the fastener tape and that is exposed at a side of the second tape-surface, and wherein as the total N adjacent tightening threads extend the respective exposed portions of the tightening threads appear at a side of the second tape-surface one-by-one alternately or one-by-one sequentially.

2. The fastener stringer according to claim 1 in which the total N adjacent tightening threads is referred to as a first group of tightening threads, wherein the plurality of warp threads includes a second group of tightening threads including total M adjacent tightening threads each repeats crossing over M second legs at a side of the first tape-surface and crossing over the weft thread at a side of the second tape-surface so as to tighten the coil-shaped element to the weft thread, said M indicating a natural number equal to or greater than 2, wherein the fastener tape includes a tape texture arranged between the first group of tightening threads and the second group of tightening threads.

3. The fastener stringer according to claim 2, wherein the plurality of warp threads includes a third group of tightening threads including total R adjacent tightening threads each repeats crossing over R second legs at a side of the first tape-surface and crossing over the weft thread at a side of the second tape-surface so as to tighten the coil-shaped element to the weft thread, said R indicating a natural number equal to or greater than 2, wherein the fastener tape includes a tape texture arranged between the second group of tightening threads and the third group of tightening threads.

4. The fastener stringer according to claim 2, wherein the tape texture includes a plain weave structure.

5. The fastener stringer according to claim 3, wherein said N and said M and said R indicate the same number.

6. A fastener stringer comprising:

a fastener tape that includes one or more weft threads and a plurality of warp threads, the fastener tape having a first tape-surface and a second tape-surface; and a coil-shaped element that is provided onto the first tape-surface of the fastener tape, the coil-shaped element including a series of unit structures, each unit structure including:

a first leg that extends along the weft thread;

a second leg arranged farther away from the weft thread than the first leg;

an engaging head that couples the first leg and the second leg at a position outwardly of fastener tape; and a return portion that couples the first leg and a second leg of an adjacent unit structure at a position inwardly of fastener tape, wherein the plurality of warp threads includes:

a plurality of first warp threads configured to repeat crossing the weft thread at first and second tape sides alternatively in a length direction of the fastener tape so as to form a tape texture on which the first legs are placed;

a plurality of second warp threads configured to repeat crossing the weft thread at the first and second tape sides alternatively in the length direction of the fastener tape so as to form a tape texture on which the first legs are placed; and total N adjacent third warp threads arranged between the plurality of first warp threads and the plurality of second warp threads, each third warp thread being configured to repeat crossing over N second legs at a side of the first tape-surface and crossing over the weft thread at a side of the second tape-surface so as to tighten the coil-shaped element to the weft thread, said N indicating a natural number equal to or greater than 2, wherein each third warp thread includes an exposed portion that crosses over the weft thread between the first legs arranged adjacent in the length direction of the fastener tape and that is exposed at a side of the second tape-surface, and wherein as the total N adjacent third warp threads extend in the length direction of the fastener tape, the respective exposed portions of the N adjacent third warp threads appear at a side of the second tape-surface one-by-one alternately or one-by-one sequentially.

7. The fastener stringer according to claim 6 in which the total N adjacent third warp threads is referred to as a first group of tightening threads, wherein the plurality of warp threads includes a second group of tightening threads including total M adjacent tightening threads each repeats crossing over M second legs at a side of the first tape-surface and crossing over the weft thread at a side of the second tape-surface so as to tighten the coil-shaped element to the weft thread, said M indicating a natural number equal to or greater than 2.

8. The fastener stringer according to claim 7, wherein the plurality of warp threads includes a third group of tightening threads including total R adjacent tightening threads each repeats crossing over R second legs at a side of the first tape-surface and crossing over the weft thread at a side of the second tape-surface so as to tighten the coil-shaped element to the weft thread, said R indicating a natural number equal to or greater than 2.

9. The fastener stringer according to claim 7, wherein the fastener tape includes a tape texture arranged between the first and second groups of tightening threads, and this tape texture includes a plain weave structure.

10. The fastener stringer according to claim 8, wherein said N and said M and said R indicate the same number.

11. The fastener stringer according to claim 6, wherein only a pair of laterally extending portions of the weft thread is provided between the first legs arranged adjacent in the length direction of the fastener tape, and each third warp thread extends to cross the pair of laterally extending portions of the weft thread so as to form a recess at the second tape side between the first legs in the length direction of the fastener tape.

12. The fastener stringer according to claim 6, wherein a number of warp threads in the plurality of first warp threads is the same as a number of warp threads in the plurality of second warp threads.

13. The fastener stringer according to claim 6, wherein a number of warp threads in the plurality of first warp threads is equal to or greater than 3, and a number of warp threads in the plurality of second warp threads is equal to or greater than 3.

14. The fastener stringer according to claim 6, wherein the plurality of warp threads except for the total N adjacent third warp threads is configured to structure the fastener tape as a single flat sheet.

15. The fastener stringer according to claim 6, wherein no core thread is provided inside the coil-shaped elements.

16. A fastener stringer comprising:

a fastener tape that includes one or more weft threads and a plurality of warp threads, the fastener tape having a first tape-surface and a second tape-surface; and a coil-shaped element that is provided onto the first tape-surface of the fastener tape, the coil-shaped element including a series of unit structures, each unit structure including;

a first leg that extends along the weft thread;

a second leg arranged further away from the weft thread than the first leg;

an engaging head that couples the first leg and the second leg at a position outwardly of fastener tape; and a return portion that couples the first leg and a second leg of an adjacent unit structure at a position inwardly of fastener tape, wherein the plurality of warp threads includes;

a plurality of first warp threads configured to repeat crossing the weft thread at first and second tape sides alternately in a length direction of the fastener tape so as to form a tape texture on which the first legs are placed;

a plurality of second warp threads configured to repeat crossing the weft thread at the first and second tape sides alternately in the length direction of the fastener tape so as to form a tape texture on which the first legs are placed; and 3 or more adjacent third warp threads arranged between the plurality of first warp threads and the plurality of second warp threads, each third warp thread bring configured to repeat crossing over 3 or more second legs at the side of the first tape-surface and crossing over the weft thread at the side of the second tape-surface so as to tighten the coil-shaped element to the weft thread, wherein a number of the adjacent third warp threads and a number of the second legs crossed by each adjacent third warp thread are equal, and wherein each third warp thread includes an exposed portion that crosses over the weft thread between the first legs arranged adjacent in a length direction of the fastener tape and that is exposed at the side of the second tape-surface, and wherein as the 3 or more adjacent third warp threads extend in the length direction of the fastener tape, the respective exposed portions of the 3 or more adjacent third warp threads appear at the side of the second tape-surface one-by-one sequentially.

17. The fastener stringer according to claim 16, wherein only a pair of laterally extending portions of the weft thread is provided between the first legs arranged adjacent in the length direction of the fastener tape, and each third warp threads extends to cross the pair of laterally extending portions of the weft thread so as to form a recess at the second tape side between the first legs in the length direction of the fastener tape.

18. The fastener stringer according to claim 16, wherein the number of warp threads in the plurality of first warp threads is the same as the number of warp threads in the plurality of second warp threads.

19. The fastener stringer according to claim 16, wherein the number of warp threads in the plurality of first warp threads is equal to or greater than 3, and the number of warp threads in the plurality of second warp threads is equal to or greater than 3.

20. The fastener stringer according to claim 16, wherein the plurality of warp threads except for the 3 or more adjacent third warp threads is configured to structure the fastener tape as a single flat sheet.

* * * * *